US006910695B2

(12) United States Patent
Ellington

(10) Patent No.: US 6,910,695 B2
(45) Date of Patent: Jun. 28, 2005

(54) SNOWBOARD HAVING AN ELEVATED DECK

(75) Inventor: Eric Ellington, San Diego, CA (US)

(73) Assignee: Kabushiki Kaisha Aki International, Yono (JP)

( * ) Notice: Subject to any disclaimer, the term of this patent is extended or adjusted under 35 U.S.C. 154(b) by 0 days.

(21) Appl. No.: 09/779,183

(22) Filed: Feb. 8, 2001

(65) Prior Publication Data

US 2002/0008360 A1 Jan. 24, 2002

(30) Foreign Application Priority Data

Jul. 24, 2000 (JP) ..... 2000-222457

(51) Int. Cl.[7] ..... B62B 13/00

(52) U.S. Cl. ..... 280/14.22; 280/607

(58) Field of Search ..... 280/11.12, 602, 280/607, 609, 11.14, 11.17, 636, 809, 818, 28.16, 617, 618, 14.21, 14.22, 14.24, 14.25, 14.26, 28.14; D12/10, 9

(56) References Cited

U.S. PATENT DOCUMENTS

| | | | | | |
|---|---|---|---|---|---|
| 1,569,885 | A | * | 1/1926 | Roblee | |
| D178,325 | S | * | 7/1956 | Nelson | D12/10 |
| D202,116 | S | * | 8/1965 | Thomas | D12/10 |
| D206,011 | S | * | 10/1966 | Price | D12/10 |
| 3,343,847 | A | * | 9/1967 | Christy | 280/14.21 |
| D222,090 | S | * | 9/1971 | Davis | |
| 3,744,811 | A | * | 7/1973 | Johnston | |
| 3,778,077 | A | * | 12/1973 | Johnson | |
| 3,782,744 | A | * | 1/1974 | Milovich et al. | |
| 3,797,839 | A | * | 3/1974 | Smolka et al. | 280/617 |
| D232,164 | S | * | 7/1974 | Bemis et al. | |
| 3,830,513 | A | * | 8/1974 | Hunt | |
| 4,199,162 | A | * | 4/1980 | Joy | |
| 4,225,145 | A | * | 9/1980 | Carr | 280/7.14 |
| 4,320,905 | A | * | 3/1982 | Andrew | 280/14.21 |
| 4,349,208 | A | * | 9/1982 | Merrill | |
| 4,804,200 | A | * | 2/1989 | Kuchler | 280/602 |
| 4,848,781 | A | * | 7/1989 | Dykema et al. | 280/14.2 |
| 5,544,919 | A | * | 8/1996 | Tinkler | 280/809 |
| 5,580,077 | A | * | 12/1996 | Dodge | 280/607 |
| 5,820,154 | A | * | 10/1998 | Howe | 280/602 |
| 5,915,721 | A | * | 6/1999 | Laughlin | 280/617 |
| 6,149,182 | A | * | 11/2000 | Wyssen | 280/607 X |
| D466,834 | S | * | 12/2002 | Oldendorph | D12/10 |
| 6,513,826 | B1 | * | 2/2003 | Hangl | 280/602 |
| 6,648,348 | B2 | * | 11/2003 | Link | 280/14.25 |
| 2002/0070515 | A1 | * | 6/2002 | Barbieri et al. | |
| 2002/0158430 | A1 | * | 10/2002 | Farcot et al. | |
| 2003/0085537 | A1 | * | 5/2003 | Breuer et al. | |
| 2003/0160404 | A1 | * | 8/2003 | Bobrowicz | 280/14.21 |
| 2004/0145152 | A1 | * | 7/2004 | Santa Cruz et al. | 280/602 |

FOREIGN PATENT DOCUMENTS

| | | | |
|---|---|---|---|
| CH | 627655 | * | 1/1982 |
| DE | 3505255 | * | 8/1986 |
| DE | 3628623 | * | 3/1988 |
| DE | 3702093 | * | 8/1988 |
| JP | 1185277 | | 7/1989 |
| JP | 2-15183 | | 1/1990 |
| JP | 9225085 | | 9/1997 |

* cited by examiner

*Primary Examiner*—Bryan Fischmann
(74) *Attorney, Agent, or Firm*—Carrier, Blackman & Associates, P.C.; Joseph P. Carrier; William D. Blackman

(57) ABSTRACT

A snowboard includes a slide board and a step board which are joined by a connecting member in a substantially parallel and spaced relationship. Because of the elevated position of the step board, the snowboarder gains a leverage in controlling the edges of the slide board without any substantial effort. Therefore, the snowboarder is enabled to control the snowboard without requiring his or her boots to be fixed to the snowboard. Also, because the snowboarder can move his or her feet on the deck at will, this additionally increases the freedom in shifting of the weight. Therefore, as opposed to the conventional snowboard which does not provide any such leverage, and restrains the snowboarder's feet to fixed positions thereon, the snowboarder is allowed to shift his or her weight much more effortlessly, and perform a greater variety of tricks.

22 Claims, 3 Drawing Sheets

SNOWBOARD HAVING AN ELEVATED DECK

TECHNICAL FIELD

The present invention relates to a snowboard for sliding over snow, and in particular to a snowboard which allows the snowboarder to enjoy the actions which were available only with a skateboard but have been considered impossible with a snowboard.

BACKGROUND OF THE INVENTION

The conventional snowboard comprises an elongated board adapted to slide over snow, and a binding arrangement provided on the deck or the top surface thereof. The snowboarder attaches his or her snow boots to the top surface of the snowboard by using the binding arrangement, and slides down a snow slope on top of the snowboard while carving turns by shifting his weight and controlling the edges of the snowboard.

However, according to the conventional snowboard, because the snowboarder's boots are fixedly secured to the top surface of the snowboard, the snowboarder is unable to move on the snowboard, and can therefore shift his or her weight only with a significant effort. Also, many of the tricks employed in skateboarding, such as ollie, nollie, shove-it and various flips, are not possible with the conventional snowboard.

BRIEF SUMMARY OF THE INVENTION

In view of such problems of the prior art, a primary object of the present invention is to provide a snowboard which facilitates for the snowboarder to shift his or her weight on the snowboard.

A second object of the present invention is to provide a snowboard which allows many of the attractive tricks of the skateboard to be performed on snow.

According to the present invention, such objects can be accomplished by providing a snowboard for sliding over snow, comprising: an elongated slide board having a slide surface on a lower surface thereof; and an elongated step board defining a deck on an upper surface thereof, and attached to an upper surface of the slide board in a substantially parallel and spaced relationship via a connecting member.

According to this snowboard, because of the elevated position of the step board, the snowboarder gains a leverage in controlling the edges of the slide board without any substantial effort. Therefore, the snowboarder is enabled to control the snowboard without requiring his or her boots to be fixedly secured to the snowboard. Also, because the snowboarder can move his or her feet on the deck at will, this additionally increases the freedom in the shifting of the weight. Therefore, as opposed to the conventional snowboard which does not provide any such leverage, and fixedly restrains the snowboarder's feet, the snowboarder is allowed to shift his or her weight much more effortlessly, and perform a greater variety of tricks.

Also, because the snowboarder can flip the snowboard or otherwise detach his or her feet from the snowboard much in the same way as a skateboard, many of the spectacular tricks which have been considered to be unique to skateboarding can be accomplished with the snowboard of the present invention.

Typically, the slide board and step board are joined at their middle parts by using a suitable connecting member.

Preferably, the slide board and step board are aligned with each other with respect to their longitudinal and lateral center lines so that they are disposed substantially symmetrically as a whole.

To favorably take advantage of the leverage offered by the elevated position of the deck in using the edges of the slide board by shifting the weight of the snowboarder on the deck, the step board is preferably somewhat greater in both length and width than the slide board.

To allow the snowboard to be flipped with the toe of the snowboarder, the step board may be optionally provided with at least one engagement portion in a nose part thereof.

To allow the beginner to get quickly accustomed to the snowboard of the present invention, the snowboard may be optionally provided with boot bindings. For instance, the beginner may start practicing with his or her boots attached to the snowboard in the first stage. After getting used to the new snowboard, one of the boots may be detached from the binding, and allowed to move freely in the second stage. Once the snowboarder has sufficiently gotten accustomed to the new snowboard, both his or her boots may be allowed to move freely to enjoy the full benefit of the snowboard of the present invention. The beginner may also start from the second stage if desired.

The binding may be adapted to totally secure the boot, but may also allow the toe to pivot around the heel, or vice versa. Alternatively, the boot may be allowed to move linearly either longitudinally or laterally.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
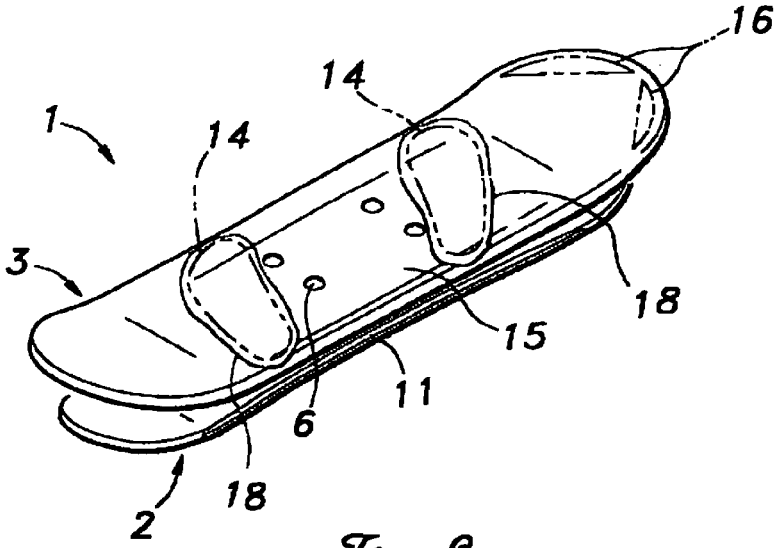
FIG. 1 is a perspective view of a snowboard embodying the present invention.
Figure 2:
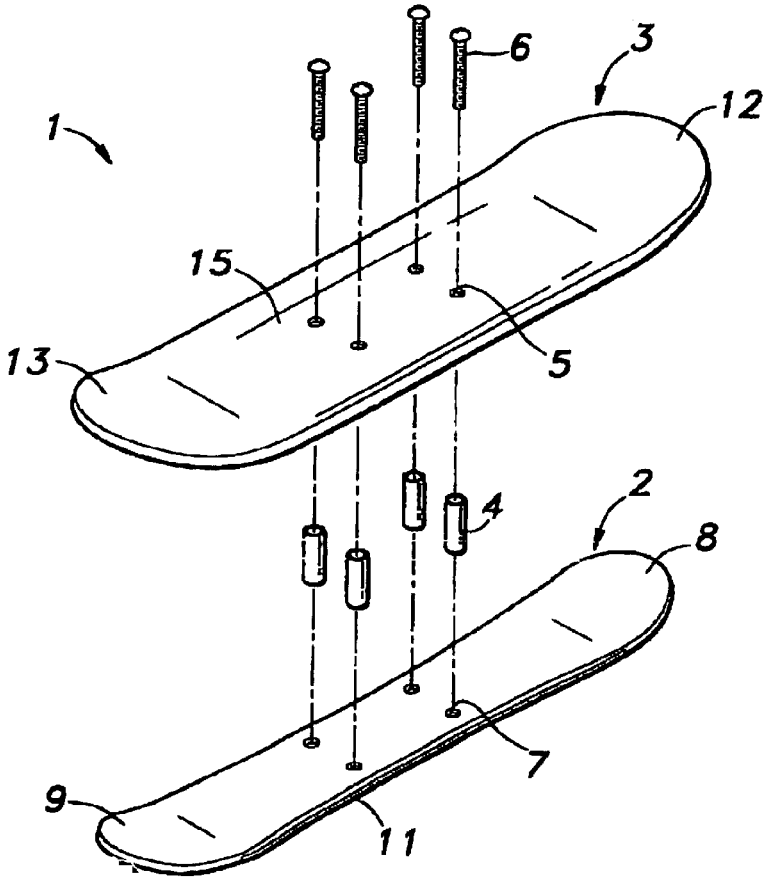
FIG. 2 is an exploded perspective view of the snowboard.

Referring to FIGS. 1 and 2, the snowboard 1 embodying the present invention comprises a lower slide board 2 and an upper step board 3 which are joined by coupling members consisting of four identical tubular members 4. Each of the tubular members 4 is fixedly secured by a threaded bolt 6 which is passed downward through a hole 5 formed in the step board 3 and the inner bore of the tubular member 4, and threaded into a nut 7 fixedly embedded in the slide board 2. In this embodiment, the tubular connecting members 4 are arranged in a rectangular formation, but they may be replaced with a single central member or a plurality of members arranged in a different formation.

Figure 3:
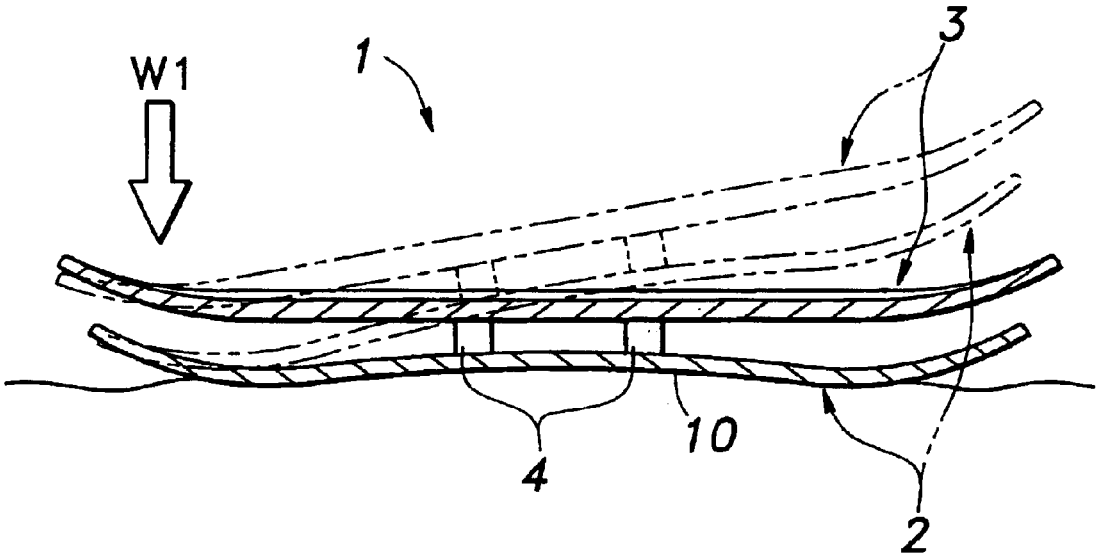
FIG. 3 is a sectional view taken longitudinally across the snowboard.

The slide board 2 has a nose 8 and a tail 9 which are curved upward, and an intermediate part defining side edges 11 and a sliding surface 10 on a lower surface thereof (FIG. 3). The slide board 2 may be made of any known materials used for making the conventional snowboards or skis.

The step board 3 may consist of any board on which the snowboarder can stand, and comprises a nose 12, a tail 13 and an intermediate part defining a deck 15 on an upper surface thereof. The nose 12 and tail 13 of the step board 3 are also curved upward. When snowboarding, the snowboarder typically places his or her boots on the deck 15 at a small angle with respect to the lateral direction, substantially in the same way as with a conventional snowboard. If desired, the deck 15 may be lined with a suitable friction surface to prevent the slipping of the boots on the deck 15. Typical positions of the snowboarder's boots are indicated by imaginary lines 14 in FIG. 1. The nose 12 may be provided with engagement members 16.

Figure 5:
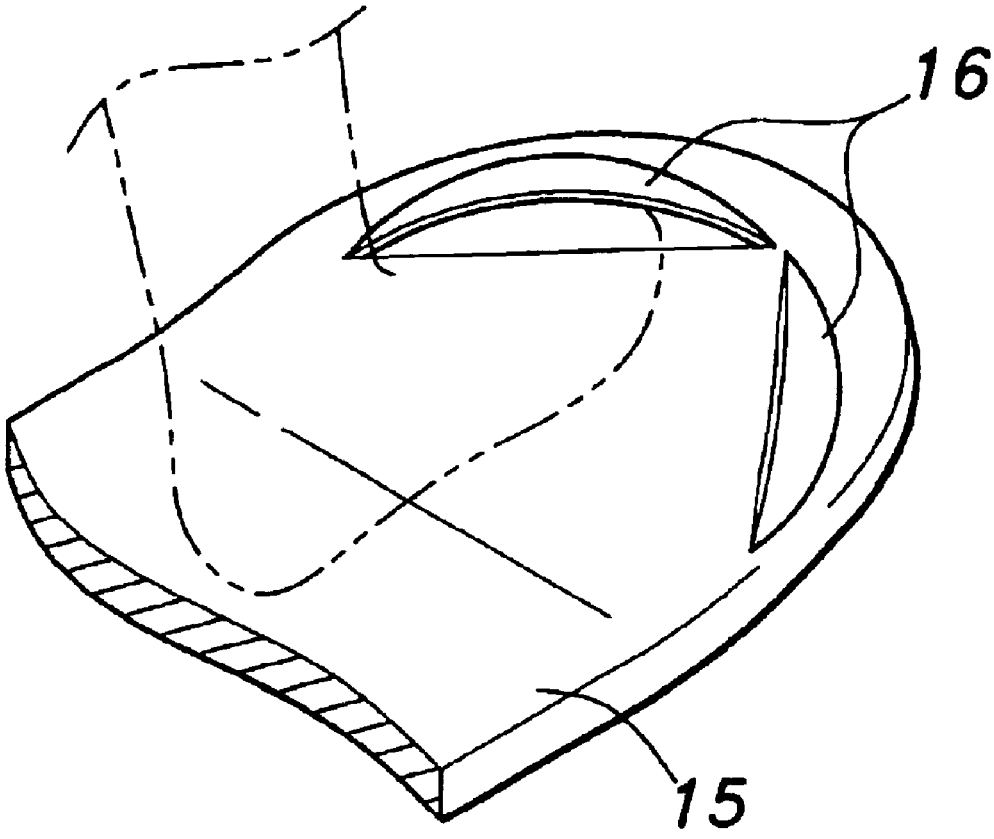
FIG. 5 is an enlarged fragmentary perspective view of the toe portion of the step board.

As best illustrated in FIG. 5, the engagement members 16 are each cup-shaped, and adapted to receive the snowboarder's toe to allow the snowboarder to hook the snowboard while making a jump or for flipping the snowboard 1. If the snowboarder uses only one of his toes for hooking the snowboard 1, only one such engagement member may be provided on the corresponding side of the step board 3. If desired, the engagement members 16 may be suitably adapted to be readily detachable.

Figure 4:
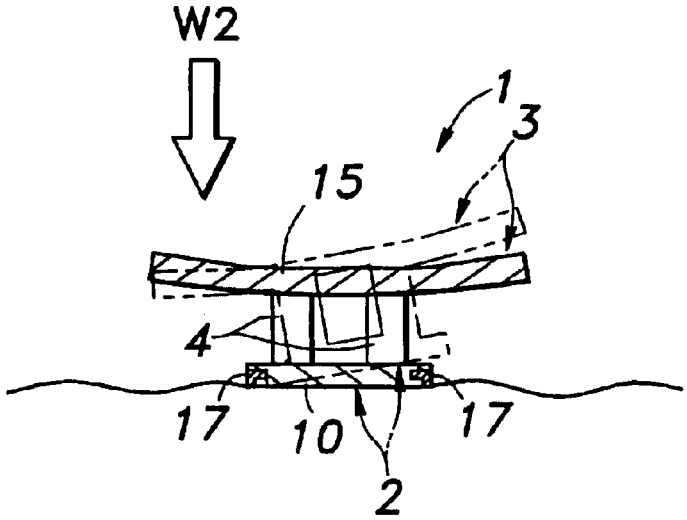
FIG. 4 is a sectional view taken laterally across the snowboard.

The slide board 2 and the step board 3 may come in any sizes. However, to improve the functionality and handling, preferably, the length and width of the step board are somewhat greater than those of the slide board by an appreciable amount, such as shown in FIGS. 3–4. The length and the width of the step board are normally smaller than those of the conventional snowboard.

According to a typically construction of the snowboard of the present invention, the slide board 2 is 80 cm long and 10 cm wide, and the step board 3 is 2 to 3 cm longer and 10 cm wider. The distance between the slide board 2 and step board 3 is approximately 15 cm. Therefore, the step board 3 is longer and wider than the slide board 2, but is somewhat shorter and narrower than the conventional snowboard which is typically 140 to 150 cm long and approximately 25 cm wide.

The four connecting tubular members 4 retain the slide board 2 and step board 3 in affixed parallel relationship in cooperation with the threaded bolts 6 and nuts 7, and are typically provided inward of the depicted imaginary lines 14 where the boots of the snowboarder are placed. The tubular members 4 are typically made of hard plastic material or metallic material. As will be understood, the tubular members, as well as the bolts 6 and nuts 7, are made of relatively rigid, substantially non-compressible materials, such that they maintain a substantially fixed height arid substantially prevent relative pivoting between the slide and step boards.

The deck 15 of the step board 3 is normally not provided with any boot bindings, but may also be provided with bindings particularly for a beginner to get quickly accustomed to the snowboard of the present invention. In such a case, a pair of bindings may be provided on the step board 3 for the right and left boots of the snowboarder. For such bindings, reference should be made to numerous prior U.S. patents that can be readily searched as having the titles including "snowboard binding", and those available on the market. Because such bindings by themselves do not form a part of the present invention, the description of the boot bindings are omitted in this disclosure, while bindings 18 are very generally depicted in FIG. 1. Alternatively, only one binding may be provided on the step board 3 for the boot on the side of the nose 12 so that the left boot may be moved freely while the right boot is fixedly secured. It is also possible to allow a limited movement, such as a linear movement or a pivotal movement, to the binding or bindings.

When riding the snowboard of the present invention, the snowboarder puts the snowboard 1 on a snow slope and places both his boots on the step board 3. The snowboarder then can slide down the slope with the nose first while shifting his or her weight appropriately. His or her weight can be shifted either keeping his or her boots fixed or changing the positions of his or her boots on the step board 3 as required.

Referring to FIG. 3, when his or her weight is shifted toward the tail as indicated by arrow W1, the nose tends to rise as indicated by the imaginary lines. Conversely, when his or her weight is shifted toward the nose, the tail tends to rise. Referring to FIG. 4, when carving a turn, the snowboarder's weight is shifted sideways as indicated by arrow W2 so that the side edge of the corresponding side acts upon the snow as indicated by the imaginary lines. To ensure a favorable edge action, the side edges of the slide board 2 may be reinforced each with an edge member 17 made of harder material. In this case, because of the leverage gained by virtue of the elevated position of the step board 3, and the freedom in the movement of the boots, the shifting of the weight of the boarder can be accomplished with much less effort than in the case of the conventional snowboard.

Various tricks of skateboarding, such as ollie, nollie, shove-it and various flips, can be effected by kicking the nose or tail of the step board much in the same way as in skateboarding, and spectacular tricks which have not been possible with the conventional snowboard can be made possible.

Although the present invention has been described in terms of a preferred embodiment thereof, it is obvious to a person skilled in the art that various alterations and modifications are possible without departing from the scope of the present invention which is set forth in the appended claims.

What is claimed is:

1. An elevated deck snowboard for sliding over snow, comprising:

an elongated slide board having a slide surface on a lower surface thereof and having a defined length;

an elongated step board defining a deck on an upper surface thereof which is capable of freely accommodating both feet of a user, and attached to an upper surface of the slide board in spaced and substantially parallel relationship via a connecting assembly including a plurality of connecting members, the step board having a length substantially equal to or greater than the length of the slide board;

the connecting assembly being disposed inwardly of peripheral edges of the slide and step boards; and the connecting assembly substantially preventing the slide board and step board from pivoting relative to each other in at least a lateral direction of the snowboard where connected by said connecting members during use of the snowboard, such that when in use, the step board is capable of allowing significant leverage to be applied to the peripheral edges of the slide board.

2. A snowboard according to claim 1, wherein the connecting assembly is provided in longitudinally middle parts of the slide and step boards and includes at least two of said connecting members spaced from each other in a longitudinal direction of the snowboard.

3. A snowboard according to claim 1, wherein the step board is appreciably greater in width than the slide board.

4. A snowboard according to claim 1, wherein the step board is provided with an engagement portion for allowing engagement of a toe of a snowboarder in a nose part thereof.

5. A snowboard according to claim 1, wherein the step board is provided with at least one boot binding.

6. A snowboard according to claim 1, wherein the connecting assembly substantially completely prevents the slide board and step board from moving relative to each other where connected by said connecting members during use of the snowboard.

7. A snowboard according to claim 1, wherein said connecting members are formed of substantially rigid material and substantially immovably fixed between the slide board and the step board.

8. A snowboard according to claim 7, wherein the connecting members are substantially tubular in shape.

9. A snowboard according to claim 1, wherein the connecting assembly includes at least two of said connecting members spaced from each other in a longitudinal direction of the snowboard.

10. A snowboard according to claim 1, wherein said connecting assembly is disposed closer to lateral peripheral edges of the slide and step boards than to longitudinal peripheral edges of the slide and step boards.

11. An elevated deck snowboard for sliding over snow, comprising:

an elongated slide board having a slide surface on a lower surface thereof; and an elongated step board defining a deck on an upper surface thereof which is capable of freely accommodating both feet of a user, and attached to an upper surface of the slide board in spaced and substantially parallel non-integral relationship via a connecting assembly comprising a plurality of connecting members disposed inwardly of peripheral edges of the slide and step boards and made of substantially non-compressible and relatively rigid material such that portions of the slide and step boards remain in a fixed, substantially parallel and spaced relationship where connected by the connecting members during use of the snowboard;

wherein the spacing between the slide board and step board is greater than the combined thickness of the slide board and the step board.

12. A snowboard according to claim 11, wherein the connecting members are formed of at least one of hard plastic material and metallic material.

13. A snowboard according to claim 11, wherein the connecting members are substantially tubular in shape.

14. A snowboard according to claim 11, wherein the connecting assembly is provided in longitudinally middle parts of the slide board and step board.

15. A snowboard according to claim 11, wherein the step board is appreciably greater in width than the slide board.

16. A snowboard according to claim 11, wherein said connecting assembly is disposed closer to lateral peripheral edges of the slide and step boards than to longitudinal peripheral edges of the slide and step boards.

17. An elevated deck snowboard for sliding over snow, comprising:

an elongated slide board having a slide surface on a lower surface thereof and snow engaging peripheral edges, said slide board having a defined length;

an elongated step board defining a deck on an upper surface thereof which is capable of freely accommodating both feet of a user, and a connecting assembly made of substantially non-compressible material connecting the step board to an upper surface of the slide board in spaced and substantially parallel relationship, said step board being constructed and arranged to permit a user's feet to be shifted on the step board during use for imparting leverage through the step board to control orientation of the slide board on the snow;

the connecting assembly being disposed at intermediate portions of the slide and step boards inwardly of the peripheral edges of the slide and step boards, and substantially prohibiting at least lateral pivoting movement between portions of the boards where connected by the connecting assembly during use of the snowboard;

wherein the step board has a length substantially equal to or greater than the length of the slide board, and wherein the connection between the two boards is limited to that provided by the connecting assembly.

18. A snowboard according to claim 17, wherein the connecting assembly is made of substantially non-compressible and relatively rigid material and is substantially immovably fixed between the slide board and the step board.

19. An elevated deck snowboard for sliding over snow, comprising:

an elongated slide board having a slide surface on a lower surface thereof;

an elongated step board defining a deck on an upper surface thereof which is capable of freely accommodating both feet of a user; and a connecting assembly made of substantially non-compressible material connecting the step board to an upper surface of the slide board in spaced and substantially parallel relationship, and to allow a substantially increased leverage for the user in controlling the slide board by prohibiting at least lateral pivoting movement between portions of the slide and step boards where connected by the connecting assembly during use of the snowboard, the connecting assembly being disposed at intermediate portions of the slide and step boards inwardly of peripheral edges of the slide and step boards;

wherein the connecting assembly spaces the step board upwardly away from the slide board by a distance which is greater than the thickness of the slide board.

20. A snowboard according to claim 19, wherein the connecting assembly substantially prohibits all relative movement between portions of the slide and step boards where connected by the connecting assembly during use of the snowboard.

21. A snowboard according to claim 19, wherein said connecting assembly is disposed closer to lateral peripheral edges of the slide and step boards than to longitudinal peripheral edges of the slide and step boards.

22. An elevated deck snowboard for sliding over snow, comprising:

an elongated slide board having a slide surface on a lower surface thereof and having peripheral edges;

an elongated step board defining a deck on an upper surface thereof which is capable of accommodating both feet of a user, said step board having peripheral edges; and a plurality of connecting members non-integrally connecting the step board to an upper surface of the slide board in spaced and substantially parallel relationship, the connecting assembly substantially preventing the slide board and step board from pivoting relative to each other in at least a lateral direction of the snowboard where connected by said connecting members during use of the snowboard, and the connecting members being disposed inwardly of the peripheral edges of the slide and step boards;

wherein open spaces are defined between the peripheral edges of the boards, and wherein the connecting members space the step board upwardly away from the slide board by a distance which is greater than the combined thickness of the two boards.

* * * * *

UNITED STATES PATENT AND TRADEMARK OFFICE

CERTIFICATE OF CORRECTION

PATENT NO. : 6,910,695 B2
DATED : June 28, 2005
INVENTOR(S) : Eric Ellington

It is certified that error appears in the above-identified patent and that said Letters Patent is hereby corrected as shown below:

Title page,
Item [73], Assignee, change "Kabushiki Kaisha Aki International" to -- Kabushiki Kaisha AKI International --.

Column 1,
Lines 33-34, change "which facilitates for the snowboarder" to -- which permits the snowboarder --.

Column 3,
Line 27, change "to a typically construction" to -- to a typical constuction --.
Line 38, change "in affixed parallel relationship" to -- in a fixed parallel relationship --.
Line 60, change "bindings are omitted in this" to -- bindings is omitted in this --.

Signed and Sealed this

Fourth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,910,695 B2
APPLICATION NO. : 09/779183
DATED : June 28, 2005
INVENTOR(S) : Eric Ellington It is certified that error appears in the above-identified patent and that said Letters Patent is hereby corrected as shown below:

On the title page:

In section "(73) Assignee:", change "Kabushiki Kaisha Aki International" to --Kabushiki Kaisha AKI International--.

Column 1:

Lines 33-34, change "which facilitates for the snowboarder" to --which permits the snowboarder--.

Column 3:

Line 27, change "to a typically construction" to --to a typical construction--.

Line 38, change "in affixed parallel relationship" to --in a fixed parallel relationship--.

Line 60, change "bindings are omitted in this" to --bindings is omitted in this--.

Signed and Sealed this

First Day of May, 2007

JON W. DUDAS
*Director of the United States Patent and Trademark Office*